US010145206B2

(12) United States Patent
Williamson

(10) Patent No.: US 10,145,206 B2
(45) Date of Patent: Dec. 4, 2018

(54) ADJUSTABLE CHOKE DEVICE FOR A PRODUCTION TUBE

(71) Applicant: HALLIBURTON ENERGY SERVICES, INC., Houston, TX (US)

(72) Inventor: Jimmie Robert Williamson, Carrollton, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 365 days.

(21) Appl. No.: 14/911,430

(22) PCT Filed: Dec. 23, 2013

(86) PCT No.: PCT/US2013/077603

§ 371 (c)(1),
(2) Date: Feb. 10, 2016

(87) PCT Pub. No.: WO2015/099685

PCT Pub. Date: Jul. 2, 2015

(65) Prior Publication Data

US 2016/0194935 A1 Jul. 7, 2016

(51) Int. Cl.
*E21B 34/06* (2006.01)
*E21B 23/02* (2006.01)
(Continued)

(52) U.S. Cl.
CPC ..... *E21B 34/06* (2013.01); *E21B 23/02* (2013.01); *E21B 34/14* (2013.01); *E21B 43/12* (2013.01); *E21B 2034/007* (2013.01)

(58) Field of Classification Search
CPC .... E21B 2034/007; E21B 23/02; E21B 34/06; E21B 34/14; E21B 43/12
See application file for complete search history.

(56) References Cited

U.S. PATENT DOCUMENTS 6,041,857 A 3/2000 Carmody et al.
6,241,015 B1 6/2001 Pringle et al.
(Continued)

FOREIGN PATENT DOCUMENTS

WO 2012/160377 A2 11/2012

OTHER PUBLICATIONS

CONNEXUS, The Baker Hughes Magazine, 2011, vol. 2 No. 2.
International Search Report and Written Opinion dated Sep. 25, 2014 in International Application No. PCT/US2013/077603.

*Primary Examiner* — Caroline N Butcher
(74) *Attorney, Agent, or Firm* — Polsinelli PC

(57) ABSTRACT

Variable flow, internally adjustable choke (100) configured to be incorporated into a production tubing (200) of a subterranean well (300). The internally adjustable choke (100) includes a cylindrical choke body (102) having a longitudinal centerline (104); a cylindrical flow adjustment sleeve (110) concentrically and interiorly located with respect to the body (102); a plurality of fluid inlets (120) into the body (102) that establish fluid communication from outside the body (102) to an inlet annular reservoir (122) within the body (102); a pair of cylindrical, longitudinally aligned annular rings (130, 132), each ring (130, 132) having a plurality of longitudinally oriented flow ports 140 therethrough; an outlet annular reservoir (160) within the body (102); and a plurality of open ports (170) through the sleeve (110), each at least partially radially aligned with the outlet annular reservoir (160) and open thereto for fluid communication therewith.

19 Claims, 5 Drawing Sheets

(51) Int. Cl.

| | |
|---|---|
| ***E21B 43/12*** | (2006.01) |
| ***E21B 34/14*** | (2006.01) |
| *E21B 34/00* | (2006.01) |

(56) References Cited

U.S. PATENT DOCUMENTS

| | | | | |
|---|---|---|---|---|
| 6,422,317 | B1 | 7/2002 | Williamson, Jr. | |
| 6,612,547 | B2 | 9/2003 | Carmody et al. | |
| 6,860,330 | B2 | 3/2005 | Jackson | |
| 6,923,273 | B2 | 8/2005 | Terry et al. | |
| 7,055,598 | B2 | 6/2006 | Ross et al. | |
| 7,377,327 | B2 | 5/2008 | Jackson | |
| 7,429,030 | B2 | 9/2008 | Dwivedi | |
| 8,297,358 | B2 | 10/2012 | Korkmaz et al. | |
| 8,316,945 | B2 | 11/2012 | Robichaux et al. | |
| 8,316,953 | B2 | 11/2012 | Reid et al. | |
| 8,408,302 | B2 | 4/2013 | Robichaux et al. | |
| 2006/0113089 | A1* | 6/2006 | Henriksen | E21B 34/08 166/386 |
| 2006/0157257 | A1* | 7/2006 | Ross | E21B 43/08 166/386 |
| 2008/0128129 | A1* | 6/2008 | Yeh | E21B 17/02 166/275 |
| 2008/0224085 | A1* | 9/2008 | Coull | E21B 34/12 251/356 |
| 2009/0151790 | A1 | 6/2009 | Ranjan et al. | |

* cited by examiner

ADJUSTABLE CHOKE DEVICE FOR A PRODUCTION TUBE

CROSS-REFERENCE TO RELATED APPLICATIONS

This application is a national stage entry of PCT/US2013/077603 filed Dec. 23, 2013, said application is expressly incorporated herein in its entirety.

FIELD

The subject matter herein generally relates to controlling flow into a production tube.

BACKGROUND

In the production of formation fluids, the use of isolation methods can be implemented. For example, a well can include a casing and production tubing. The production tubing can be spaced within the well by a series of packers which control the flow within the annulus formed between the casing and the production tubing.

BRIEF DESCRIPTION OF THE DRAWINGS

Implementations of the present technology will now be described, by way of example only, with reference to the attached figures, wherein.

DETAILED DESCRIPTION

Figure 1:
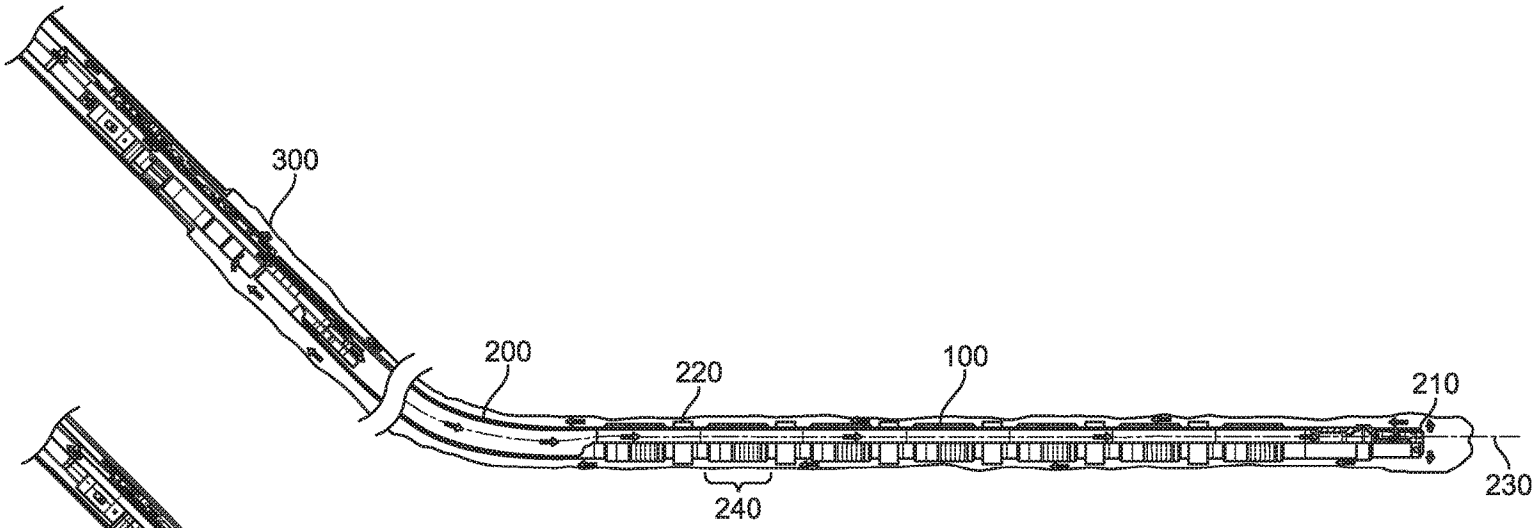
FIG. 1 is an example of a subterranean well having a production tubing and adjustable choke devices, according to the present disclosure, wherein fluid flow is directed downhole through the production tubing.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

In the following description, terms such as "upper," "upward," "lower," "downward," "above," "below," "downhole," "uphole," "longitudinal," "lateral," and the like, as used herein, shall mean in relation to the bottom or furthest extent of, the surrounding wellbore even though the wellbore or portions of it may be deviated or horizontal. Correspondingly, the transverse, axial, lateral, longitudinal, radial, etc., orientations shall mean orientations relative to the orientation of the wellbore or tool. Additionally, the illustrate embodiments are illustrated such that the orientation is such that the right-hand side is downhole compared to the left-hand side.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicate that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder.

The term "radially" means substantially in a direction along a radius of the object, even if the object is not exactly circular or cylindrical. The term "axially" means substantially along a direction of the axis of the object. If not specified, the term axially is such that it refers to the longer axis of the object.

The present disclosure is described in relation to an adjustable choke device that is implemented with respect to a production tubing, the present disclosure contemplates implementation of the adjustable choke device with any flow situation in which fluid flows between an outside of a body to an inside of a body. Particularly, the present embodiments concern flow that is at least partially in an axial and radial direction.

While the below described embodiments have been generally described as substantially cylindrical, it is appreciated that portions of the adjustable choke device 100 can have a non-cylindrical form. As one implementation as presented herein is with respect to a production tubing 200, the description refers to the implementation as cylindrical in view thereof. It is appreciated, that the present technology can be implemented in other environments in addition to the production tubing as presented herein.

FIG. 1 is an example of a subterranean well 300 having a production tubing 200 and adjustable choke devices 100, according to the present disclosure. As illustrated, the fluid flow is directed through the production tubing 200 and out an end 210 of the production tubing 200. The production tubing 200 can also have packers 220 that are spaced out along the production tubing 200. The packers 220 can be spaced apart along a central axis 230 of the production tubing 200. The packers 220 allow for isolation of zones 140 for production. The isolation of the zones 240 by the packers 220 allow for a controlled completion process.

Figure 2:
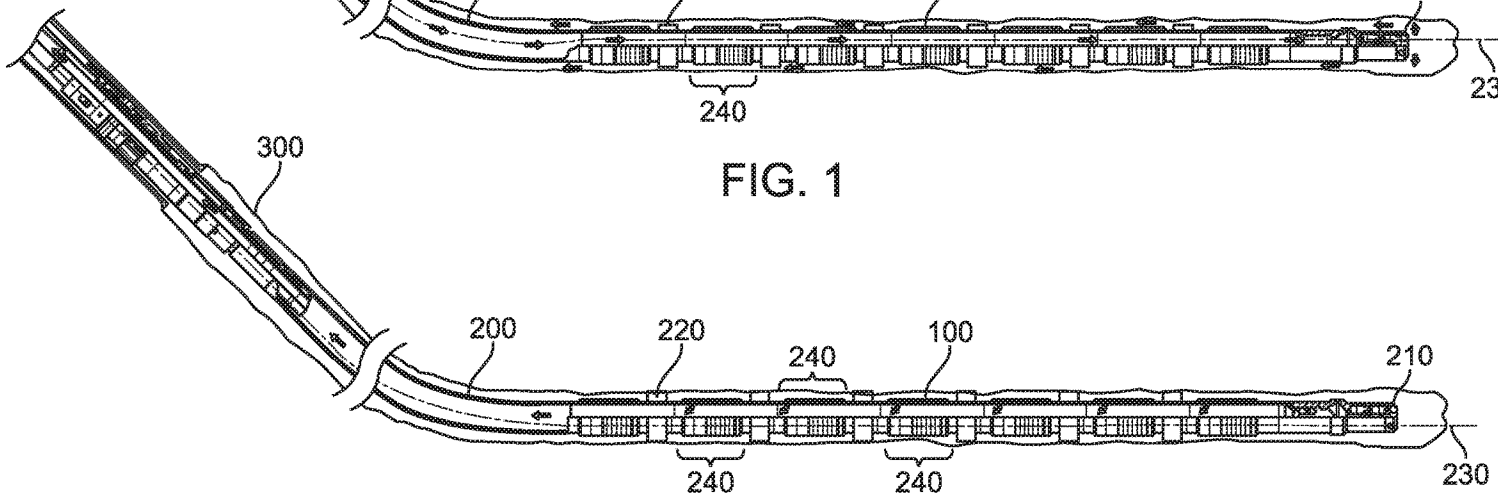
FIG. 2 is an example of a subterranean well having a production tubing and adjustable choke devices, according to the present disclosure, wherein fluid flow is directed upstream through the production tubing.

FIG. 2 is an example of a subterranean well 300 having a production tubing 200 and adjustable choke devices 100, according to the present disclosure. As illustrated, the subterranean well 300 is in a production phase such that fluid flows into the production tubing 200 by passing through the adjustable choke devices 100. The packers 220, as described above separate the isolations zones 240 from each other. The adjustable choke devices 100 can each be individually controlled. For example, one of the adjustable choke devices 100 can be set to a fully open configuration such that a maximum amount of flow can enter the production tubing 200 through the adjustable choke device 100. Another one of the adjustable choke devices 100 can be set to a fully closed configuration in which no fluid enters the production tubing 200 through the adjustable choke device 100. Yet other adjustable choke devices 100 can be set to an open configuration between 1% to 99% open. Using the adjustable choke devices 100 as presented herein, each zone 240 can be controlled. A tool can be run inside of the production tubing 200 to control the configuration of the respective adjustable choke device 100. Thus, production can be controlled to maximize the production from a given well 300 or used in combination with other wells to maximize the production for a given formation. The presently described adjustable choke device 100 can also be used to control flow from the production tubing 200 into a well 300 when fluid is sent downhole through the production tubing 200. Additionally, the adjustable choke 100 can be used to control the flow of fluids in other situations and implementations.

Figure 3:
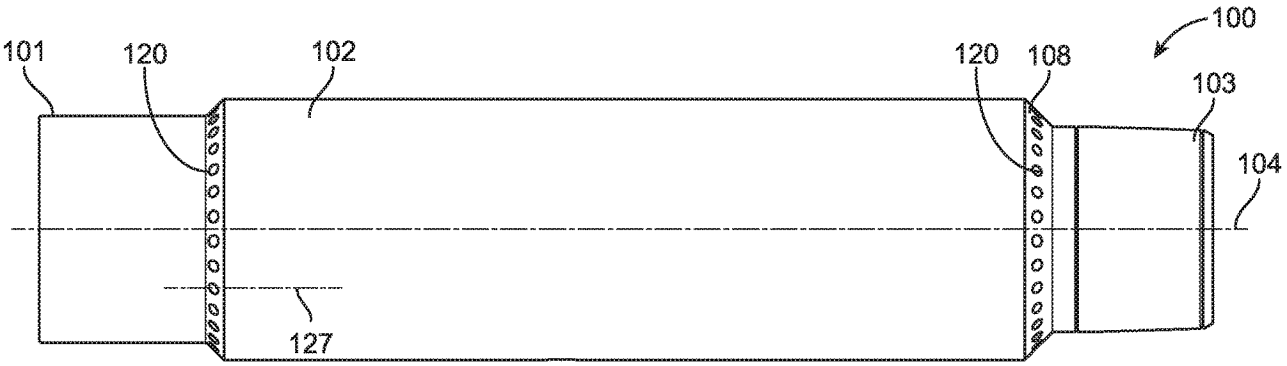
FIG. 3 is an example of a side elevation view of an adjustable choke device according to the present technology.

FIG. 3 is an example of a side elevation view of an adjustable choke device 100 according to the present technology. The adjustable choke device 100 can include a cylindrical choke body 102. The cylindrical choke body 102 can include a plurality of fluid inlets 120. The plurality of fluid inlets 120 allow fluid to flow from the outside of the cylindrical choke body 102 to an inside of the cylindrical choke body 102. The adjustable choke device 100 can include an uphole end 101 (uphole referring to the direction of fluid flow in production) and a downhole end 103. The cylindrical choke body 102 can have a longitudinal centerline 104. As illustrated, the cylindrical choke body 102 can be configured to be interconnected into a production tubing 200 of a subterranean well 300. Each of the plurality of fluid inlets 120 can each have a respective centerline 127.

In at least one embodiment, the adjustable choke device 100 can be integrated with a sand screen to prevent ingress of sand into the adjustable choke device 100. For example, a sand screen can be installed around a circumscribing shoulder 108 of the cylindrical choke body 102. The sand screen can be removably coupled in at least one configuration. In yet another configuration, the sand screen can be permanently coupled to the adjustable choke device 100. In still another embodiment, the adjustable choke device 100 can be installed within a sand screen.

The adjustable choke device 100 can be removably coupled to a production tubing 200 at an uphole end 101 and a downhole end 103. The coupling at either the uphole end 101 or downhole end 103 can be a screwed coupling. Other examples of releasable coupling include pressfit couplings, expansion couplers, and pinned couplers. Additionally, the coupling of the adjustable choke device can be a fixedly coupling such that the adjustable choke device 100 is welded to production tubing at the uphold end 101 or downhole end 103. Other examples of fixed couplers include bonding and casting. The adjustable choke device 100 can be removably coupled at one of the two ends (101, 103) and fixed coupling at the other end.

Figure 4:
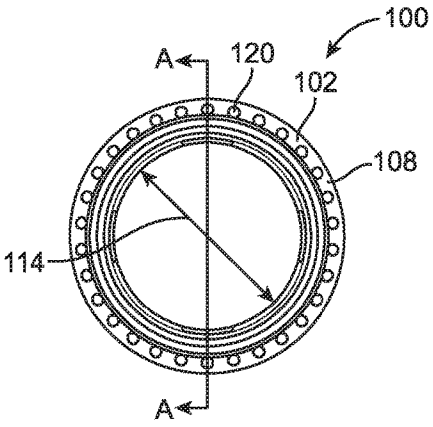
FIG. 4 is an example of an end elevation view of an adjustable choke device, in a closed configuration, according to the present technology.

FIG. 4 is an example of an end side elevation view of an adjustable choke device 100, in a closed configuration, according to the present technology. As described above, the adjustable choke device 100 can be configured to be in a fully closed configuration, a fully open configuration or any desired configuration therebetween. As illustrated, the adjustable choke device 100 has an internal diameter 114. The internal diameter 114 can correspond to a nominal inside tubing diameter of the production tubing 200. In other embodiments, the internal diameter 114 can be smaller than the nominal tubing diameter of the production tubing 200. Also, as illustrated the plurality of fluid inlets 120 can have a substantially circular opening formed on the circumscribing shoulder 108 of the cylindrical choke body 102.

Figure 5:
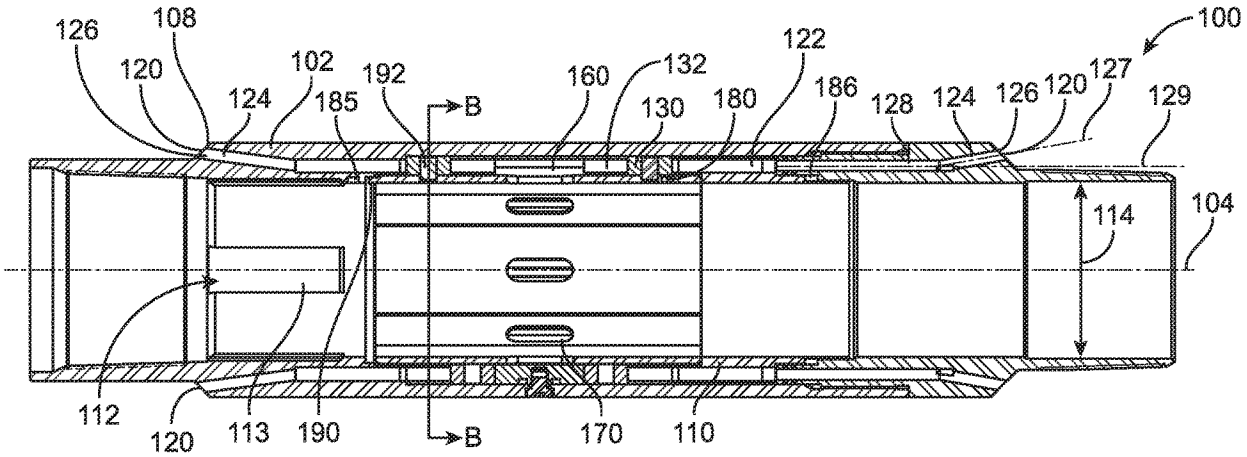
FIG. 5 is an example section view of the adjustable choke device of FIG. 4 along section line A-A.

FIG. 5 is an example section view of the adjustable choke device 100 of FIG. 4 along section line A-A. The cross-section view as illustrated in FIG. 5 reveals several of the details of the internal components of the adjustable choke device 100. While many of the components are described herein, it can be appreciated that not all of the components are described or illustrated for clarity. The plurality of fluid inlets 120 into the cylindrical choke body 102 can establish fluid communication from outside the cylindrical choke body 102 to an inlet annular reservoir 122 located within the cylindrical choke body 102.

Each of the plurality of fluid inlets 120 can include a fluid inlet tubule 124 within the cylindrical choke body 102. The fluid inlet tubule 124 can have an inlet aperture 126 at an exterior of the cylindrical choke body 102 in fluid communication with an elongate extension channel 128 that is in fluid communication with the inlet annular reservoir 122. When an inlet annular reservoir 122 is provided, the inlet annular reservoir 122 serves as a collection area such that the fluid that flows through the plurality of fluid inlets 120 can be collected prior to flowing through the pair of cylindrical, longitudinally aligned annular rings (130, 132). The size of the inlet annular reservoir 122 can be sized based on the expected production direction through the plurality of fluid inlets 120. For example, the annular reservoir 122 on the downhole side of the adjustable choke device 100 can be larger than the uphole side of the adjustable choke device 100 based on the expected fluid flow direction. For example, the uphole side of the adjustable choke device 100 can be located in close proximity to a packer 220 so that less flow is expected through the plurality of fluid inlets 120 on the uphole side of the adjustable choke device 100.

Each of the inlet apertures 126 can have a centerline 127 that is aligned substantially longitudinally with respect to the cylindrical choke body 102 of the adjustable choke device 100. The inlet aperture 126 can open to the exterior of the adjustable choke device 100 at a circumscribing shoulder 108 of the cylindrical choke body 102.

The elongate extension channel 128 can be cylindrically shaped. Additionally the elongate extension channel can have a centerline 129 aligned substantially longitudinally with respect to the cylindrical choke body 102 of the adjustable choke device 100. The centerline 129 of the elongate extension channel 128 can be longitudinally aligned with respect to the cylindrical choke body 102 of the adjustable choke device 100.

The adjustable choke device 100 can also include a cylindrical flow adjustment sleeve 110 that can be concentrically and interiorly located with respect to the cylindrical chock body 102. The cylindrical flow adjustment sleeve 110 can be coupled to the cylindrical choke body 102 for relative rotation therebetween. In at least one embodiment, the cylindrical flow adjustment sleeve 110 can also be configured to adjust the flow rate from the outside of the cylindrical choke body 102 into an interior thereof.

The adjustable choke device 100 can also include a pair of cylindrical, longitudinally aligned annular rings (130, 132). The pair of annular rings (130, 132) can be arranged adjacent to one another. In at least one embodiment, one 130 of the pair of annular rings (130, 132) can be coupled to the cylindrical flow adjustment sleeve 110. In another embodiment, one 130 of the pair of annular rings (130, 132) can be fixed to the cylindrical flow adjustment sleeve 110. Additionally, the other 132 of the pair of annular rings (130, 132) can be coupled to the body 102 for relative rotation of one ring to the other upon rotation of the sleeve 110 within the body 102. Furthermore, the other 132 of the pair of annular rings (130, 132) can be fixed to the body 102 for relative rotation of one ring to the other upon rotation of the cylindrical flow adjustment sleeve 110 within the body 102.

In one example, the annular ring 130 that is coupled to the cylindrical flow adjustment sleeve 110 can be coupled via a pin 192 and a receiving portion in the cylindrical flow adjustment sleeve 110 that receives the pin 192. The pin 192 can be shaped such that it is removable or fixedly coupled to the annular ring 130. The present disclosure also contemplates a screw, bolt, clip or other releasable attachment device used in place of the pin 192. The present disclosure also contemplates a welded, glued or otherwise bonded attachment between the annular ring 130 and the cylindrical flow adjustment sleeve 110. In at least one example, the pin 192 can be used in addition to welded, glued or otherwise bonded attachment. The other annular ring 132 can similarly be coupled to the body 102.

Also, as illustrated there are two pairs of annular rings (130, 132), a first pair on the uphole side 101 of the body 102 and a second pair on the downhole side 103 of the body 102. In at least one embodiment, each ring can be formed identically. For example, the annular rings (130, 132) can each be formed using a single mold and cast. In other embodiments, each annular ring (130, 132) can be machined in the same way. In other embodiments, each respective annular ring (130, 132) can be made differently. For example, one 130 of the pair of the rings (130, 132) can be configured to couple with a receiving portion formed on the sleeve 110. The other 132 of the pair of annular rings (130, 132) can be configured to be coupled to body 102 by a coupling member (not shown).

As illustrated an outlet annular reservoir 160 can be formed within the body 102. The outlet annular reservoir 160 can circumscribe the sleeve 110. Additionally, the outlet annular reservoir 160 can be in fluid communication with a composite flow channel that is established across the rings (130, 132), when the rings are configured in at least a partially open configuration. For example as further illustrated in FIG. 5, the rings (130, 132) are oriented such that the rings (130, 132) are in a fully closed position thereby eliminating the composite flow channel and preventing fluid from entering the outlet annular reservoir 160 from the outside of the body 102.

The sleeve 110 can include a plurality of open ports 170 through the sleeve 110. Each of the plurality of open ports 170 can at least be partially aligned with the outlet annular reservoir 160 and open thereto for fluid communication therewith. In at least one embodiment, such as the one illustrated in FIG. 5, the plurality of open ports 170 can be in substantial registration with the outlet annular reservoir 160 even when the adjustable choke device 100 is configured to be in a fully closed position. In other embodiments, the plurality of open ports 170 can be configured such that no fluid can flow between the outlet annular reservoir 160 and the interior of the adjustable choke 100 when the adjustable choke 100 is in a fully closed configuration.

In at least one embodiment, the plurality of open ports 170 can have an oblong, capsule shaped cross-section. In other embodiments, the plurality of open ports 170 can have other cross-sections that allow for fluid to flow therethrough. For example, the plurality of open ports 170 can have a substantially circular cross-section, a substantially rectangular cross-section, a substantially oval cross-section, and a substantially square cross-section. The oblong, capsule shaped cross-section can provide a large fluid flow area as well as reducing corner flow problems in that the ends are substantially circular shaped.

If an operator of the production tubing 200 wants to change the configuration of the adjustable choke device 100, the operator can send a tool downhole within the production tubing 200 to change the configuration of the adjustable choke device 100. In order to accommodate the changing of the configuration of the adjustable choke 100, the cylindrical flow adjustment sleeve can include at least one keyway 112 at an internal diameter 114 of the sleeve 110. The at least one keyway 112 can receive a key of a drive tool (not shown). The drive tool can be configured to rotate the sleeve 110. When the sleeve 110 is rotated, the one 130 of the pair of rings (130, 132) can be rotated with respect to the other 132 of the pair of rings (130, 132).

In at least one embodiment, the at least one keyway 112 can include a longitudinally oriented slot 113 that is recessed into the internal diameter 114 of the sleeve 110. As illustrated, the sleeve 110 can include a plurality of keyways 112 and each keyway 112 can include a longitudinally oriented slot that is recessed into the internal diameter 114 of the sleeve 110. The number of keyways 112 can be four as illustrated. When four keyways 112 are provided, the engagement of the tool can be such that a more positive traction is established between the sleeve 110 and the tool. In another embodiment, a single keyway 112 can be used. In other embodiments, the number of keyways 112 can be two, three or greater than four depending upon the expended forces as well as the inside diameter 114 of the sleeve 110.

While the illustrated embodiment includes at least one keyway 112, the present disclosure contemplates implementation without any keyways 112. For example, the present disclosure can be implemented such that the tool includes an engagement surface that engages the internal diameter of the sleeve 110 to rotate the sleeve 110 and the associated coupled ring 130. When the sleeve 110 is provided without a keyway 112, the sleeve can allow fluid to more easily flow therethrough. In the embodiments implemented with at least one keyway 112, the at least one keyway 112 provides for a more positive engagement between the tool and the sleeve 110, thereby reducing wear on the inside of the sleeve 110 and the engagement portion of the tool.

While the present disclosure has been described above with respect to keyways 112, the present disclosure contemplates the use of other engagement surfaces that are configured to receive actuation portions of a tool configured to rotate the sleeve 110. For example, the engagement surfaces can be triangular in shape, tapered or otherwise configured.

Additionally, the adjustable choke device 100 can be provided with additional optional features to further control the adjustment of the sleeve 110 and in turn the pair of annular rings (130, 132). For example, the adjustable choke device 100 can include one or more stops 190 that present the sleeve 110 from rotating beyond a predetermined orientation. For example, the stops 190 can be provided so that the sleeve 110 is able to rotate 180 degrees. In another embodiment, the stops can be configured to allow the sleeve to rotate ninety degrees.

Additionally, the sleeve 110 can be provided with a permanent magnet 180. Additionally, the body 102 of the adjustable choke device 100 can include a fixed magnet 185. When the tool is passing through the adjustable choke device 100, the tool can determine the position of the sleeve 110 and in turn the relative positions of the pair of rings (130, 132), which in turn allows for a determination of percent of opening or flow area of the pair of rings (130, 132). As illustrated in FIG. 5, the permanent magnet 180 of the sleeve 110 can be substantially aligned with the fixed magnet 185 of the body 102. In this configuration, the tool can determine that the adjustable choke device 100 is closed so that no ingress of fluid is possible to the production tubing 200. While other configurations of the magnets 180, 185 are possible, it is the relative positioning and rotation that is important. While only a single permanent magnet 180 and single fixed magnet 185 are illustrated, present disclosure can include additional magnets. In a at least one embodiment, all of the magnets of the respective sleeve 110 and body 102 are aligned with one another.

Furthermore, an optional biasing member 186 can be included to provide for sealing and/or seating of the sleeve 110 and associated components. The biasing member 186 can be a spring. In other embodiments, the biasing member 186 can be a hydraulic member.

Figure 6:
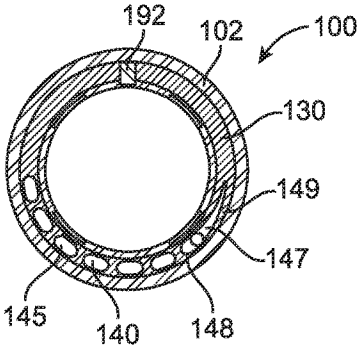
FIG. 6 is an example section view of the adjustable choke device of FIG. 5 along section line B-B.

FIG. 6 is an example section view of the adjustable choke device 100 of FIG. 5 along section line B-B. As illustrated, the one ring 130 can have flow ports 140 arranged therein. The flow ports 140 can be variably aligned with flow ports (not shown) in the other ring 132. The flow ports 140 as illustrated in FIG. 6 are aligned such that no flow port 140 matches with a flow port in the other ring, thereby preventing the fluid from flowing therethrough.

At least one 145 of the longitudinally oriented flow ports 140 through the pair of annular rings (130, 132) can be cross-sectionally oblong shaped. As illustrated, a plurality of the longitudinally oriented flow ports 140 through each of the pair of annular rings (130, 132) are cross-sectionally oblong shaped. The plurality of cross-sectionally oblong shaped flow ports 140 through a respective one of the pair of annular rings (130, 132) can be arranged in a series along the respective ring (130, 132). In at least one embodiment, at least one 147 of the plurality of the longitudinally oriented flow ports 140 through a respective one of the pair of annular rings (130, 132) can have an arched tear-drop cross-sectional shape. In at least one embodiment, only one 147 of the plurality of the longitudinally oriented flow ports 140 through a respective one of the pair of annular rings (130, 132) can have an arched tear-drop cross-sectional shape. The arched tear-drop cross-sectionally shaped flow port can have an elliptical head 148 and a curved, tapered tail 149. The elliptical head 148 of the arched tear-drop cross-sectional shaped flow port 147 is located adjacent to the plurality of cross-sectionally oblong shaped ports 145 with the curved, tapered tail 149 of the arched tear-drop cross-sectional shaped flow port 147 extending away therefrom. The arched tear-drop cross-sectional shaped flow port 147 on one ring (130, 132) can be located on an opposite end of the respective series of cross-sectionally oblong shaped flow ports 145 relative to the arched tear-drop cross-sectional shaped flow port 147 on the other ring (130, 132).

When at least one 147 of the longitudinally oriented flow ports 140 is arched tear-drop cross-sectional shaped, the control of flow can be more varied due to the size of the opening formed with the corresponding arched tear-drop cross-sectional shaped port. Additionally with a majority of the other flow ports 140 being cross-sectionally oblong shaped, the flow area can be controlled to allow maximum flow and minimal flow once opened.

Figure 7:
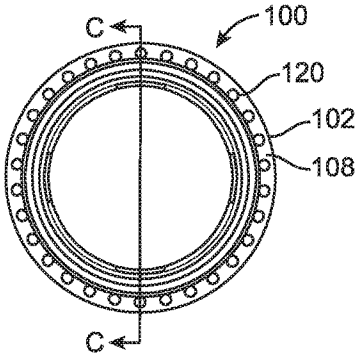
FIG. 7 is an example end side elevation view of an adjustable choke device, in a fully open configuration, according to the present technology.

FIG. 7 is an example end side elevation view of an adjustable choke device 100, in a fully closed configuration, according to the present technology. FIG. 7 resembles FIG. 4 as the inner sleeve 110 has been rotated 180 degrees between FIG. 4 and FIG. 7, so that the adjustable choke device 100 as illustrated is in a fully open configuration. As illustrated the adjustable choke device 100 can include a plurality of fluid inlets 120 and body 102. The plurality of fluid inlets 120 can be formed at a circumscribing shoulder 108 of the body.

Figure 8:
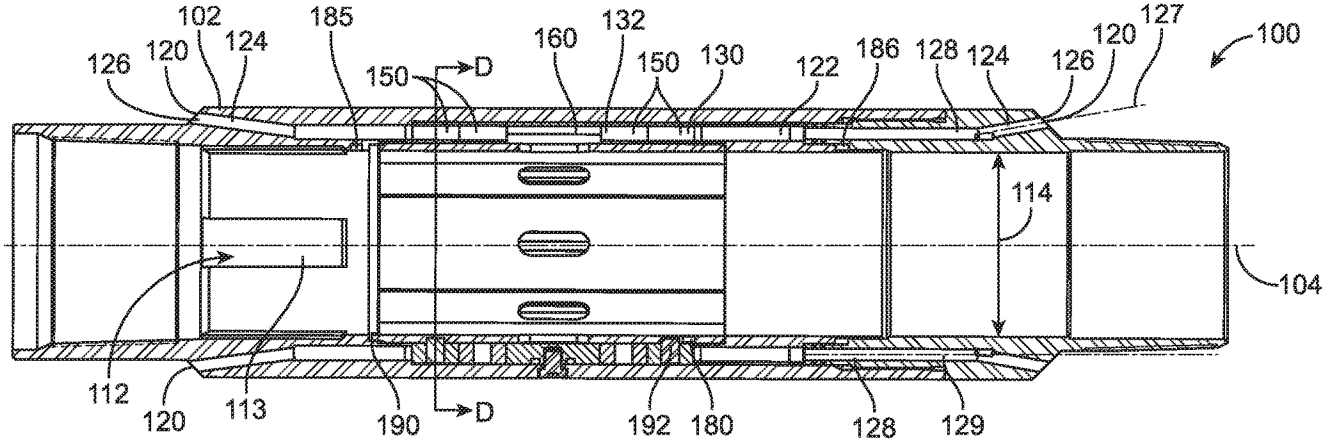
FIG. 8 is an example section view of the adjustable choke device of FIG. 7 along section line C-C.

FIG. 8 is an example section view of the adjustable choke device 100 of FIG. 7 along section line C-C. The illustrated embodiment of FIG. 8 includes the same components of the illustrated embodiment of FIG. 5 except that the sleeve 110 has been rotated 180 degrees. As illustrated, one ring 130 has been rotated relative to the other ring 132 such that the flow ports 140 in the one ring 130 are aligned with the flow ports 140 in the other ring 132 thereby establishing a composite flow channel 150 across the rings (130, 132). the relative position of the flow ports 140 in the one ring 130 can be variably alignable with the flow ports 140 of the other ring 132, thereby establishing a variably configurable composite flow channel 150 across the rings (130, 132) in dependence upon the degree of registration of the flow ports 140 of one ring 130 relative to the flow ports 140 of the other ring 132.

An outlet annular reservoir 160 can be formed within the body 102. The outlet annular reservoir 160 can circumscribe the sleeve 110 and can be in fluid communication with the composite flow channel 150 across the rings (130, 132). The area of the all of the composite flow channels 150 formed across the rings (130, 132) can be varied depending on the percentage of opening of the flow desired. For example, the sleeve 110 can be rotated to be between the open configuration illustrated in FIG. 7 and the closed configuration illustrated in FIG. 5. As the one ring 130 is rotated along with the inner sleeve 110, the flow ports 140 of the one ring 130 can come in and out of registration with respect to the flow ports 140 of the other ring.

As mentioned before, the illustrated embodiment includes a stop 190. As shown, the stop 190 has been rotated 180 degrees such that the stop is at the bottom of the body 102 as compared to being at the top of the body 102 in FIG. 5.

Furthermore, the fixed magnet 185 of the body 102 remains illustrated at the top of the body 102. The magnet 180 coupled to the sleeve 110 is illustrated as being at the bottom of the body 102. From this sensed orientation the tool determines that the magnet 180 is offset 180 degrees relative to the fixed magnet 185 and therefore the adjustable choke device 100 is in a fully open configuration. Furthermore, if the operator would like to change the percentage opening of the adjustable choke device 100, the operator can receive data representative of the current percent opening of the flow ports prior to adjusting the sleeve and a confirmation of the adjusted percentage of opening of the flow ports. From this, the percentage of opening can be assured.

Figure 9:
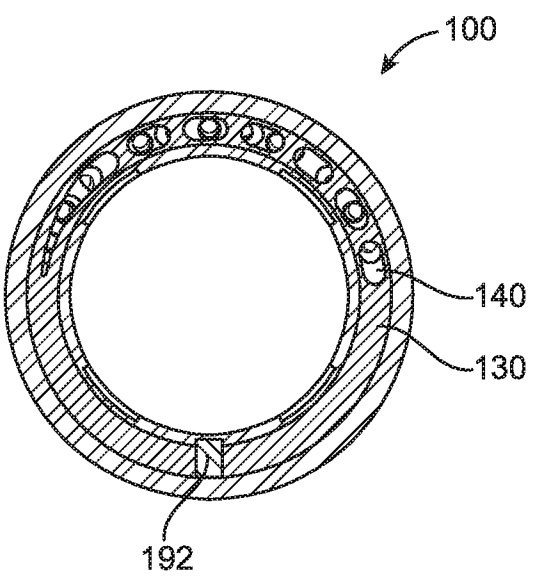
FIG. 9 is an example section view of the adjustable choke device of FIG. 8 along section line D-D.

FIG. 9 is an example section view of the adjustable choke device of FIG. 8 along section line D-D. As illustrated in FIG. 9, the fluid flow ports 140 of the one ring 130 are in substantial registration with the fluid flow ports 140 of the other ring 132, such that a maximum fluid flow area in the form of a composite flow channel 150 between the respective fluid flow ports 140 is established.

In comparing, FIG. 9 to FIG. 6, the location of the pin 192 is at the top in FIG. 6 and at the bottom in FIG. 9. Thus, it is clear that the one ring 130 has been rotated 180 degrees relative to the other. As mentioned above, in other embodiments, the present technology can be configured to have a different rotation to move between a fully open configuration and a fully closed configuration.

Figure 10:
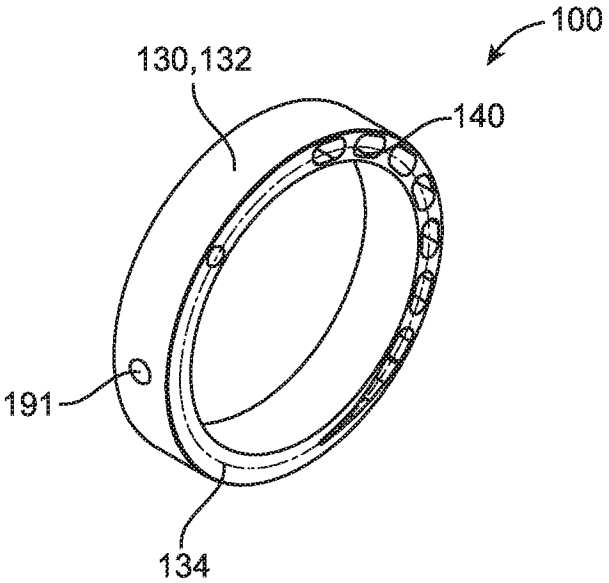
FIG. 10 is an example of a ring of the adjustable choke device according to the present technology.

FIG. 10 is an example of a ring of the adjustable choke device according to the present technology. In at least one embodiment, each ring can be formed identically. For example, the annular rings (130, 132) can each be formed using a single mold and cast. In other embodiments, each annular ring (130, 132) can be machined in the same way. In other embodiments, each respective annular ring (130, 132) can be made differently. For example, one 130 of the pair of the rings (130, 132) can be configured to couple with a receiving portion formed on the sleeve 110. The other 132 of the pair of annular rings (130, 132) can be configured to be coupled to body 102 by a coupling member (not shown).

As illustrated each of the plurality of longitudinally oriented flow ports 140 in a ring 130 of the pair of rings (130, 132) is located within a half circumference 134 of that ring 130. In another embodiment, each of the plurality of longitudinally oriented flow ports 140 in a ring or the pair of rings (130, 132) can be located within less than a half-circumference 134 of that ring 130.

As illustrated, the ring 130 includes an aperture 191 for receiving the pin 192 described above. In other embodiments, the aperture 191 can have a different size or shape. Still further, in at least one embodiment the aperture 191 can be omitted.

The embodiments shown and described above are only examples. Many details are often found in the art such as the other features of a logging system. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A variable flow, internally adjustable choke configured to be incorporated into a production tubing of a subterranean well, the internally adjustable choke comprising:

a cylindrical choke body having a longitudinal centerline and configured to be interconnected into a production tubing of a subterranean well;

a cylindrical flow adjustment sleeve concentrically and interiorly located with respect to the body, the sleeve coupled to the body for relative rotation therebetween;

a plurality of fluid inlets into the body that establish fluid communication from outside the body to an inlet annular reservoir within the body, wherein each of the plurality of fluid inlets comprises:

a fluid inlet tubule within the body, the tubule having an inlet aperture at an exterior of the body in fluid communication with an elongate extension channel that is in fluid communication with the inlet annular reservoir;

a pair of cylindrical, longitudinally aligned annular rings, one fixed to the sleeve and the other fixed to the body for relative rotation, one to the other, upon rotation of the sleeve within the body;

each ring having a plurality of longitudinally oriented flow ports therethrough, wherein the flow ports in one ring are variably alignable with the flow ports in the other ring thereby establishing a variably configurable composite flow channel across the rings in dependence upon the degree of registration of the flow ports of one ring relative to the flow ports of the other ring;

an outlet annular reservoir within the body, circumscribing the sleeve and in fluid communication with the composite flow channel across the rings; and a plurality of open ports through the sleeve, each at least partially radially aligned with the outlet annular reservoir and open thereto for fluid communication therewith.

2. The internally adjustable choke of claim 1, wherein the inlet aperture has a centerline aligned substantially longitudinally with respect to the body of the choke.

3. The internally adjustable choke of claim 1, wherein the inlet aperture opens to the exterior of the choke at a circumscribing shoulder of the body.

4. The internally adjustable choke of claim 1, wherein the elongate extension channel is cylindrically shaped and has a centerline aligned substantially longitudinally with respect to the body of the choke.

5. The internally adjustable choke of claim 4, wherein the centerline of the elongate extension channel is longitudinally aligned with respect to the body of the choke.

6. The internally adjustable choke of claim 1, wherein the cylindrical flow adjustment sleeve has at least one keyway at an internal diameter thereof for receiving a key of a drive tool.

7. The internally adjustable choke of claim 6, wherein the at least one keyway is a plurality of keyways, each comprising a longitudinally oriented slot recessed into the internal diameter of the sleeve.

8. The internally adjustable choke of claim 1, wherein each of the plurality of open ports through the sleeve has an oblong, capsule shaped cross-section.

9. The internally adjustable choke of claim 1, wherein at least one of the longitudinally oriented flow ports through the pair of annular rings is cross-sectionally oblong shaped.

10. The internally adjustable choke of claim 1, wherein a plurality of the longitudinally oriented flow ports through each of the pair of annular rings are cross-sectionally oblong shaped.

11. The internally adjustable choke of claim 10, wherein the plurality of cross-sectionally oblong shaped flow ports through a respective one of the pair of annular rings are arranged in a series along the respective ring.

12. The internally adjustable choke of claim 11, wherein at least one of the plurality of the longitudinally oriented flow ports through a respective one of the pair of annular rings has an arched tear-drop cross-sectional shape.

13. The internally adjustable choke of claim 12, wherein only one of the plurality of the longitudinally oriented flow ports through a respective one of the pair of annular rings has an arched tear-drop cross-sectional shape.

14. The internally adjustable choke of claim 13, wherein the arched tear-drop cross-sectionally shaped flow port has an elliptical head and a curved, tapered tail.

15. The internally adjustable choke of claim 14, wherein the elliptical head of the arched tear-drop cross-sectional shaped flow port is located adjacent to the plurality of cross-sectionally oblong shaped ports with the curved, tapered tail of the arched tear-drop cross-sectional shaped flow port extending away therefrom.

16. The internally adjustable choke of claim 15, wherein the arched tear-drop cross-sectional shaped flow port on one ring is located on an opposite end of the respective series of cross-sectionally oblong shaped flow ports relative to the arched tear-drop cross-sectional shaped flow port on the other ring.

17. The internally adjustable choke of claim 1, wherein at least one of the plurality of longitudinally oriented flow ports through a respective one of the pair of annular rings has an arched tear-drop cross-sectional shape.

18. The internally adjustable choke of claim 1, wherein each of the plurality of longitudinally oriented flow ports in a ring of the pair of rings is located within a half-circumference of that ring.

19. The internally adjustable choke of claim 1, wherein each of the plurality of longitudinally oriented flow ports in a ring or the pair of rings is located within less than a half-circumference of that ring.

* * * * *